United States Patent [19]

Hamm

[11] Patent Number: 4,793,764

[45] Date of Patent: Dec. 27, 1988

[54] LOADER MOUNTING SYSTEM

[75] Inventor: Nicholas Hamm, Vineland, Canada

[73] Assignee: Deere & Company, Moline, Ill.

[21] Appl. No.: 73,601

[22] Filed: Jul. 15, 1987

[51] Int. Cl.[4] ..... B66F 9/00

[52] U.S. Cl. ..... 414/686; 172/274

[58] Field of Search ..... 414/685, 686; 172/272–275

[56] References Cited

U.S. PATENT DOCUMENTS

| | | | |
|---|---|---|---|
| 3,612,311 | 10/1971 | Eidy | 172/275 X |
| 3,833,136 | 9/1974 | Spicer | 414/686 |
| 3,863,786 | 2/1975 | Frank | 414/686 |
| 3,920,138 | 11/1975 | Frank | 414/686 |
| 3,930,586 | 1/1976 | Frank | 414/686 |
| 3,949,889 | 4/1976 | Moe | 414/686 |
| 4,051,962 | 10/1977 | Westendorf | 414/686 |
| 4,217,075 | 8/1980 | Frank | 414/686 |
| 4,247,242 | 1/1981 | Goertzen | 414/686 |
| 4,266,906 | 5/1981 | Langenfeld et al. | 414/686 |
| 4,548,543 | 10/1985 | Lenertz et al. | 414/686 |
| 4,637,772 | 1/1987 | Stumpe | 414/686 |

*Primary Examiner*—Robert J. Spar
*Assistant Examiner*—Donald W. Underwood

[57] ABSTRACT

A front end loader including rear support with complementary wedge and block structure to automatically secure the mast rigidly to the tractor during mounting. A parking stand serves as a forward latching lever when the loader is mounted and additionally functions as a tractor grille guard and structural member to tie the mast arms together.

18 Claims, 4 Drawing Sheets

FIG. 1
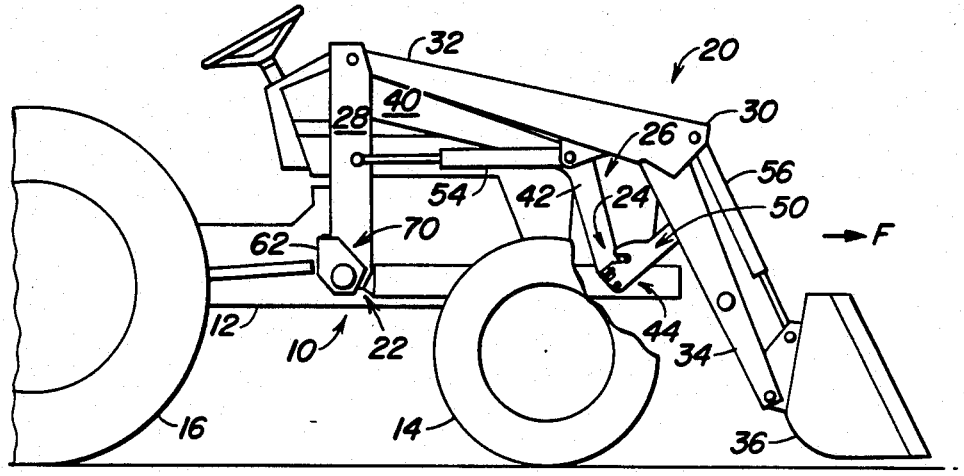
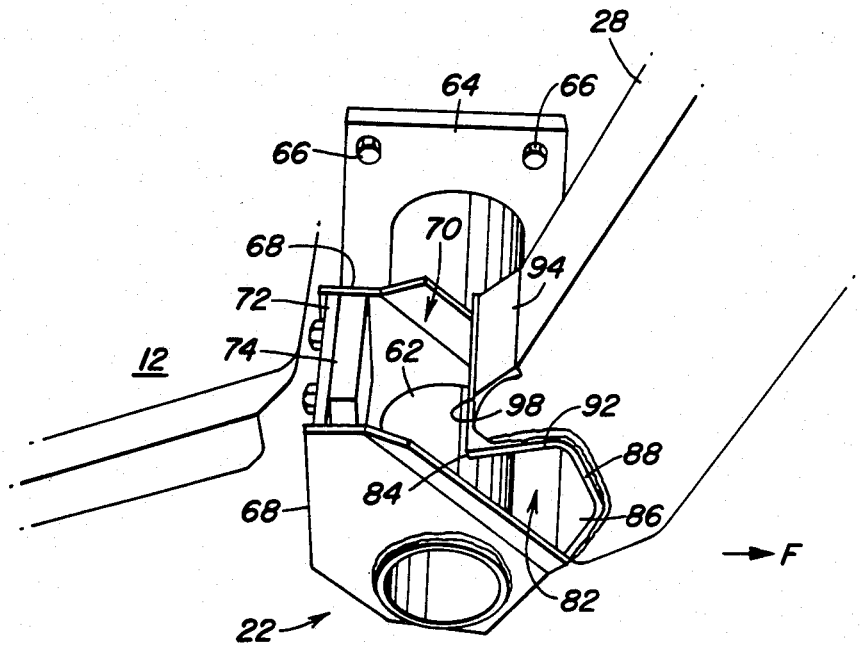
FIG. 2

LOADER MOUNTING SYSTEM

BACKGROUND OF THE INVENTION

The present invention relates generally to loaders for mounting on tractors or the like, and more specifically to an improved method and apparatus for mounting and storing a loader.

To improve the versatility of tractors, implements such as front end loaders must be easily and quickly removable and installable on the tractor. Presently there are numerous systems and methods used to remove and install a loader with respect to a tractor. However, the systems and methods are not always easily understood nor are they reliable. Many utilize parking stands which are removed and stored in another location when the loader is mounted on the tractor. Although some stands are available which remain with the loader, these can be cumbersome when the loader is mounted and may not provide optimum parking position for the loader. Also, for optimum operation, the loader must be rigidly mounted on the tractor. Although numerous systems have been employed to provide a rigid mount, many of these are complex, bulk,, or difficult to mount or adjust.

BRIEF DESCRIPTION OF THE INVENTION

It is therefore an object of the present invention to provide an improved method and apparatus for attaching and storing a tractor-mounted loader. It is a further object to provide such a method and apparatus which overcome many of the problems associated with previously available loaders.

It is another object of the present invention to provide an improved method and apparatus for mounting and storing a tractor-mounted loader which facilitate mounting and storing of the loader, and which provide a reliable and rigid mount for the loader in the mounted position. It is a further object to provide such a method and apparatus which eliminate separate hardware such as mounting bolts and removable parking stands.

It is another object of the present invention to provide an improved method and apparatus for mounting and storing a tractor-mounted loader which include utilization of a multi-function front attaching structure. It is a further object to provide such a method and apparatus wherein the front attaching structure also functions as a parking stand and a structural member to tie the two mast arms together. It is a further object to provide such a method and apparatus wherein the structure additionally acts as a grille guard in the mounted position and as a lever to provide mechanical advantage for latching the front of the loader during mounting of the loader on the tractor.

It is still a further object of the present invention to provide an improved method and apparatus for rigidly connecting a tractor-mounted loader to the tractor. It is a further object to provide such a structure and apparatus which is relatively simple and provides automatic locking and tightening of the rear support structure of the loader. It is a further object to provide such a method and apparatus having an improved geometry wherein most of the loader operations, including forward ramming, drop and catch and digging will actually tighten the mast connection of the loader at the rear supports.

In accordance with the above objects, loader mounts consisting of two front supports and two rear supports include a pair of mounting tubes which are bolted to the tractor. A cradle assembly connected to each mounting tube includes a pair of flared plates and an adjustable bolt-mounted wedge. Each mast post includes a downwardly and rearwardly opening pocket at its lower end with a block adapted for contact with the wedge as the loader frame is rotated upwardly about the mounting tubes. As the mast rotates about the mounting tubes, the blocks are forced under their respective wedges to provide a tight, automatically locking connection. The front of the loader is then secured to the forward end of the tractor.

The loader is connected at the front supports by an over center latching lever which provides good mechanical advantage and also serves as a structural member to tie the mast arms together. The lever is utilized as a stand to support the loader in the parked position. Once the lever is moved to the latching position, it acts as a grille guard to protect the front of the tractor. A spring-loaded pin secures the lever in the latching position.

To park the loader, the pin is pulled and the parking stand is rotated downwardly. The mast cylinders are extended to lower the parking stand to the ground as the masts pivot about the rear supports. As the masts pivot, the blocks move away from the corresponding wedges to automatically release the aft end of the loader from the tractor. When adequate tire clearance is achieved, the loader hydraulics are disconnected and the tractor is driven out from between the masts.

These and other objects, features and advantages of the present invention will become apparent to those skilled in the art from the description which follows and from the drawings.

BRIEF DESCRIPTION OF THE DRAWINGS

FIG. 1 is a side view of a tractor with the loader of the present invention attached thereto.

FIG. 2 is a perspective view of the rear support structure for the loader of FIG. 1.

DESCRIPTION OF THE PREFERRED EMBODIMENT

Figure 8:
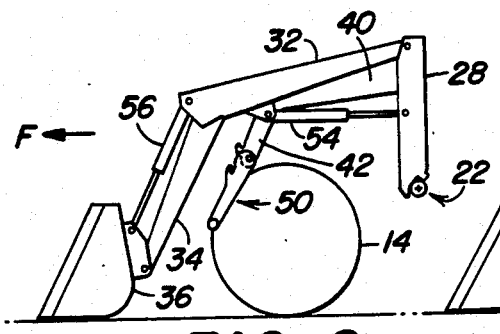
FIG. 8 is a schematic representation of the loader prior to dismounting with the latching lever in position to function as a parking stand.
Figure 9:
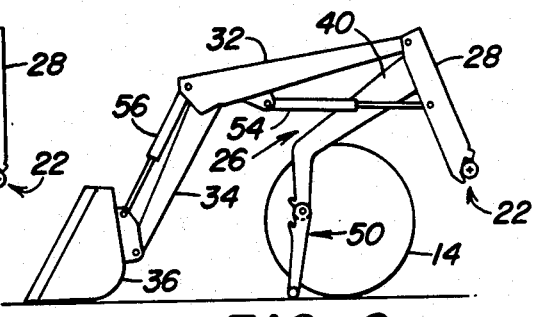
FIG. 9 is a view similar to FIG. 8 but showing the loader rotated downwardly with the stand engaging the ground.

Referring to FIG. 1, there is shown a tractor 10 having a main frame 12 supported for forward movement (F) over the ground by front ground engaging wheels 14 and rear ground engaging wheels 16. A loader 20 is connected to the tractor frame 12 by left- and right-hand rear supports 22 and by front supports 24. The loader 20 is generally symmetrical about an upright longitudinal axis and includes a mast 26 having a pair of mast posts 28 releasably secured in position, as described in detail below, on the rear supports 22. A boom 30 includes rear boom arms 32 pivotally connected at their aft ends to the upper ends of the respective mast posts 28. A forward boom arm 34 extends downwardly from each of the arms 32 to a lower portion which is pivotally connected to a bucket 36 or other earth engaging implement.

Fixed to a portion of the mast post 28 below the boom pivot is a mast arm 40 which extends forwardly and generally horizontally to a forward mast arm portion 42 which in turn angles downwardly and forwardly to a lower front support engaging portion indicated generally at 44. Pivotally connected to the lower end of the mast arm portion 42 is a parking stand or lever structure 50 which also serves as a latch for maintaining the mast structure in position on the front end of the tractor, and as a grille guard and a structural member to tie the two mast arms together.

Boom cylinders 54 are connected between the central portions of the mast posts 28 and the front portions of the corresponding rear boom arms 32. Bucket actuating cylinders 56 are connected between the forward end of the boom arms 32 and the bucket 36. The cylinders 54 and 56 are operably connected through releasable hoses to the hydraulic system (not shown) on the tractor 10.

Figure 4:
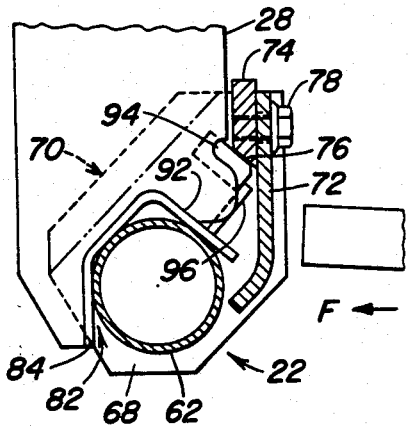
FIG. 4 is a view similar to FIG. 3 but showing the mast post in the mounted position.
Figure 3:
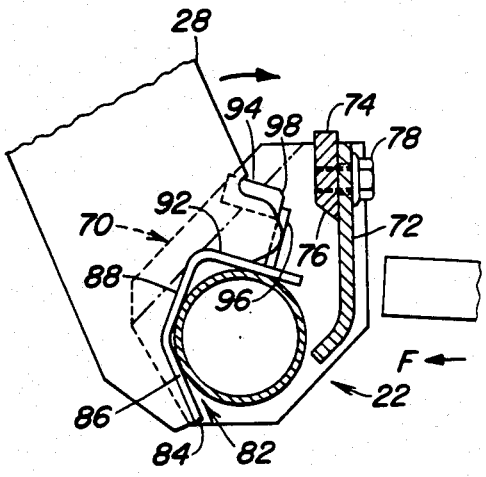
FIG. 3 is a side view, partially in section, of the rear support structure of FIG. 2 showing the pocket of the corresponding mast post resting on the support tube with the forward end of the loader rotated downwardly.

The left- and right-hand rear supports 22 and the corresponding lower ends of the mast posts 28 are configured to facilitate mounting and dismounting of the loader 20 with respect to the tractor frame 12 and to automatically provide a secure, tight fit as the loader is moved toward the mounted position. As best seen in FIGS. 2–4, each rear support 22 includes a mounting tube 62 connected to a plate 64 which in turn is connected by bolts 66 to the frame 12. A pair of flared plates 68 are rigidly fixed to the tube 62 at axially spaced locations to define a forwardly and upwardly opening, cradle-like structure 70 adapted to receive the lower end of the mast post 28. A rear upright wall 72 is connected between the aft ends of the flared plates 68. A wedge 74 having a lower downwardly and rearwardly inclined surface 76 is connected by a pair of bolts 78 to the upper portion of the rear wall 72. The wedge 74 may be adjusted vertically by loosening the bolts 78 and moving the assembly with respect to the rear wall 72.

The lower end of the mast post 28 includes a downwardly and slightly rearwardly opening pocket 82 having a boundary generally conforming to the tube 62. The boundary is defined by a formed metal plate 84 having an upright front panel portion 86, a rearwardly and upwardly directed central panel portion 88, and a downwardly directed rear panel portion 92. As best seen in FIG. 2, the plate 84 is welded to the sides of the mast posts 28 and projects slightly outwardly from the sides of the posts to provide a wide stable base.

Adjacent the pocket 82, a block 94 is welded to the aft face of the post 28 above the rear panel 92 and includes a top surface which is generally parallel to the panel 92. An upright wall 96 is connected to the upper portion of the panel 92 adjacent the contact area of the panel with the tube 62 (FIGS. 3 and 4) and is welded to the block 94 and to the sides of the mast posts 28. The block 94 is chamfered at its rear edge 98 to facilitate the sliding movement of the block into and out of engagement with the inclined surface 76 of the wedge 74 as the loader is mounted and dismounted, respectively.

Figure 10:
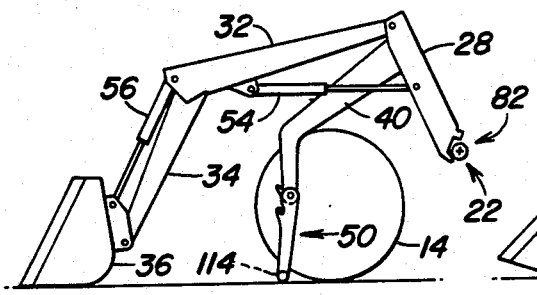
FIG. 10 is a view similar to FIG. 9 but showing the mast removed from the rear support so that the tractor may be backed away from the loader.
Figure 5:
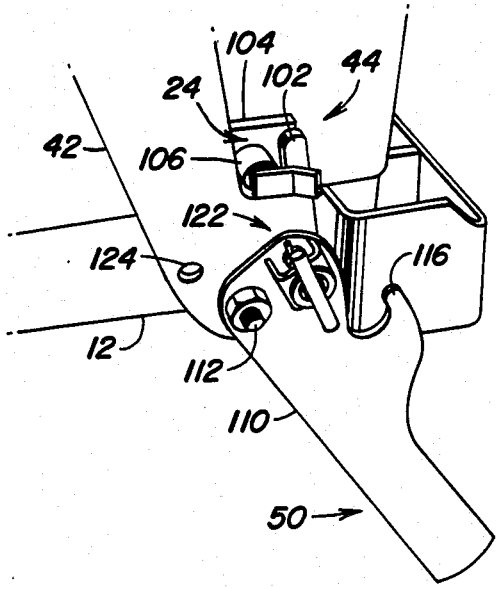
FIG. 5 and FIG. 12 are also perspective view of the over center latching lever of the front support structure on the loader.

During mounting of the loader 20, the mast posts 28 are raised, for example, by extending the boom cylinders 54, to the position shown in FIG. 10. The tractor 10 is then driven between the mast posts 28 until the mast pockets 82 are located directly above the rear supports 22. Thereafter the boom cylinders 54 may be retracted to cause the mast pockets 82 to settle onto the tubes 62 (FIGS. 3 and 4) guided by the flared plates 68. Upon contact of the mast pockets 82 with the mounting tubes 62, the tubes become the pivot points for the loader and continued retraction of the boom cylinders 54 raises the mast arm 40 until the front support engaging portion 44 engages the front supports 24 (FIGS. 5 and 8). As the mast posts 28 rotate in the clockwise direction (as shown in FIGS. 3 and 4) toward the mounted position of FIG. 1, the block 94 is forced under the wedge 74 as the top of the block 94 slides against the inclined surface 76. In the final mounted position (FIG. 4) the wedge 74 urges the block 94 and the corresponding wall 96 and pocket 82 against the upper rear quadrant of the tube 62. The structure therefore provides a very secure fit of the mast posts 28 against the respective tubes 62 and automatically locks the respective post to its tube 62. As the rear mounting contact areas wear, the wedges 74 may be adjusted downwardly as necessary to insure a snug fit. The mechanical advantage provided by the long moment arm from the tip of the bucket 36 to the block 94 may be utilized to force the block 94 between the wedge 74 and the tube 62 to create a tight fit. The long moment arm is also utilized to move the block 94 away from the wedge 74 when disconnecting the loader from the tractor. Due to the unique geometry of the rear support system described above, the loading from most of the loader operations, including forward ramming, drop and catch and digging, will actually tighten the connection at the rear supports 22.

Referring now to FIGS. 1, 5–7 and 12, the operation of the parking stand 50 and the front support arrangement for securing the forward mast arm portions 42 to the forward portion of the tractor frame 12 will be described in detail. The forward mast arm portion 42 includes an upwardly opening, hook-like portion 102. A bracket 104 is connected to the tractor frame 12 and includes an outwardly projecting cylindrical member 106 adapted to engage the hook-like portion 102 upon raising of the forward end of the mast 26. The parking stand 50 includes upright side legs 110, each having a first end pivotally connected to the lower end of the mast arm portion 42 by a bolt 112. The opposite ends of the side legs 110 are connected by a transversely extending tubular beam 114 (FIG. 7) welded to the respective side legs. Each side leg 110 includes an upwardly opening hook 116 located adjacent the pivot bolt 112 for engaging the cylindrical member 106 (FIG. 6) upon upward rotation of the parking stand 50. Welded to each of the cylindrical members 106 is a forwardly opening guide member 118 which helps channel the hook 116 onto the cylindrical member 106.

Figure 6:
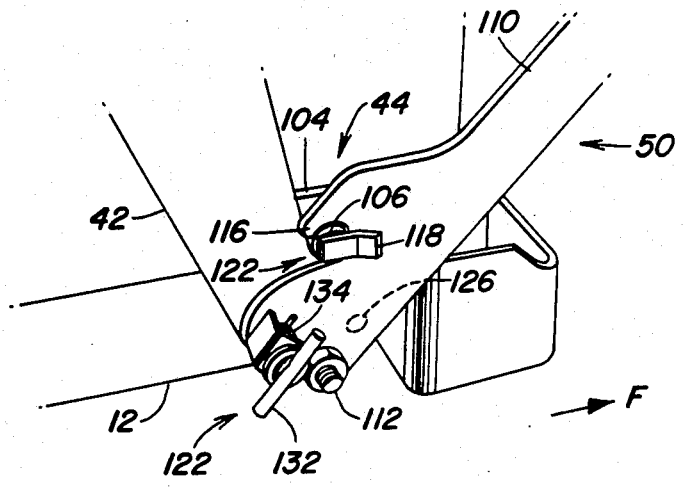
FIG. 6 is a view similar to FIG. 5 but showing the latching lever in the latched position.
Figure 7:
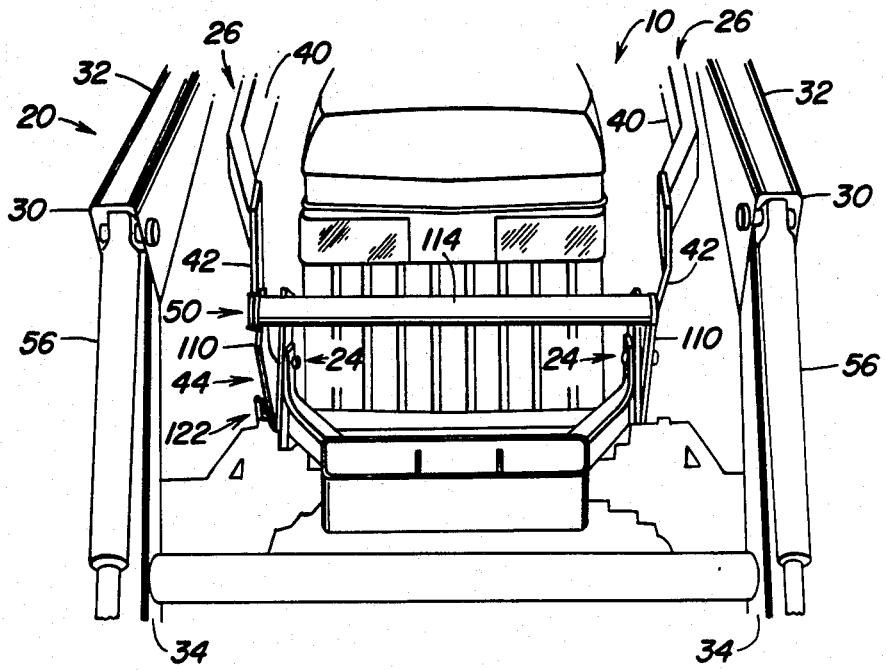
FIG. 7 is a front view of the loader when mounted on the tractor and showing the latching lever acting as both a structural member to tie the forward mast arms together and as a grille guard for the tractor.
Figure 12:
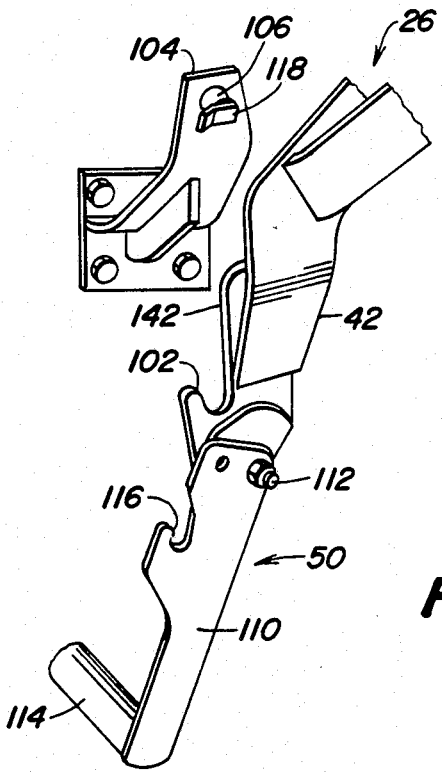

The parking stand 50 is rockable between a lowered parking position (FIGS. 9–12) and a raised latching position (FIGS. 1, 6 and 7). A spring-loaded pin assembly 122 is mounted on one side leg 11 between the hook 116 and the pivot area 112. Holes 124 (FIG. 5) and 126 (dotted lines of FIG. 6) are provided at the lower end of the forward mast arm portion 42. The hole 124 aligns with the spring-loaded pin assembly 122 when the parking stand 50 is in the latching position of FIG. 6, and pin 132 is biased into the hole 124 to secure the stand in the latched position. To rock the stand 50 toward the parked position, the pin 132 is pulled out from the hole 124, and the stand 50 is swung in the clockwise direction (FIG. 5) until the pin aligns with and enters the hole 126 to secure the stand in the parked position. The spring-loaded pin assembly 122 includes a spring 134 for biasing the pin toward the selected hole 124 or 126.

The inside of each mast arm portion 42 includes an upwardly projecting guide member 142 (FIG. 12) adjacent the area of the hook 116. The member 42 engages the bracket 104 to force the mast 26 into position as the front end of the mast 26 is raised. The guide members 142 help to properly position the forward ends of the mast arms 42 both transversely and in the fore-and-aft direction as the hook 116 moves into position on the cylindrical member 106.

Figure 11:
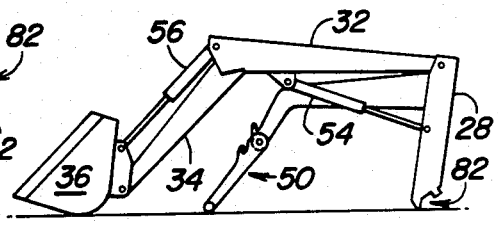
FIG. 11 is a view showing the loader in a parked position with the tractor backed away from the loader.

To park the loader 20, assuming it is in the position shown in FIG. 1, the spring-loaded pin assembly 122 is released from the hole 124 and the parking stand 50 is rotated downwardly to disengage the hook 116 from the cylindrical member 106. The pin 132 engages the second hole 126 to secure the stand 50 in the parking position. The lift cylinders 54 are then extended (FIG. 9) to rock the front end of the mast 26 downwardly about the supports 22 until the lower end of the stand 50 touches the ground. As the forward end of the mast 26 is rotated downwardly, the block 94 (FIG. 3) rotates away from the wedge 74 at each rear support 22 to release the mast post 28 from the respective support. As the lift cylinders 54 continue to extend, the masts 28 are lifted from the rear supports 22 (FIGS. 2 and 10). When adequate tire clearance is achieved, the loader hydraulics are disconnected and the tractor 10 is backed out from between the mast posts 28. The loader 20 is supported in the parked position on the stand 50 and the bucket 36 as shown in FIG. 10. If desired, the cylinders 54 may be retracted to lower the mast posts 28 into ground-engaging positions as shown in FIG. 11.

To attach the loader the above steps are reversed. Assuming the loader is in the position shown in FIG. 11, the hydraulics are hooked up to the tractor and the cylinder 54 is extended to raise the mast post to the position shown in FIG. 10. The tractor 10 then is driven forwardly until the rear supports 22 are under the respective pockets 82 of the mast posts 28. By retracting the cylinders 54, the pockets 82 of the loader mast posts 28 settle onto the rear cradle structure 70 guided by the flared plates 68. Until the pockets 82 engage the tubes 22, the loader 20 rests and pivots about the tubular cross beam 114 on the ground. Once the pockets 82 engage the rear supports 22, the mounting tubes 62 become the pivot points for the loader. Continued retraction of the cylinders 54 raises the parking stand 50 from the ground as the forward end of the mast 26 rotates upwardly. At the same time, the block 94 (FIG. 4) is forced under the wedge 74. The mast 26 continues to rotate until the hook 102 engages the cylindrical member 106 (FIG. 5). The operator then grasps the stand 50 and, using the leverage provided by the length of the side legs 110, forces the hook 116 into engagement with the cylindrical member 106 to secure the front end of the mast 26 to the tractor frame 12. The pin 132 of the assembly 122 is biased into the hole 124 to maintain the parking stand in the latched position. In the latched position, the parking stand 50 acts as a grille guard (FIG. 7) to protect the tractor grille against damage.

Having described the preferred embodiment, it will be apparent that modifications can be made without departing from the scope of the invention as defined in the accompanying claims.

I claim:

1. A method of mounting a loader on a tractor, the loader including mast structure having upright mast posts and an actuatable boom assembly rockably connected to the mast structure, said boom assembly including a material-engaging tool, the method comprising the steps of:

(a) attaching a mounting tube to the tractor;

(b) providing a downwardly opening pocket member at the lower end of one of the mast posts;

(c) moving the pocket member and mounting tube relative to each other until the pocket member engages the tube with the pocket member contacting the tube in a preselected engaging position;

(d) after the step (c), rotating the mast structure about the mounting tube to a preselected mounted position;

(e) securing a portion of the mast structure at a location offset from the mounting tube to the tractor to maintain the mast structure in the mounted position;

(f) providing complementary block and ramp structure adjacent the mounting tube and pocket, including supporting a block at the lower end of said one of the mast posts and a complimentary inclined surface adjacent the mounting tube; and (g) wedging the pocket against the mounting tube, said step of wedging including, during the step (d), rotating the block with the mast structure against the inclined surface.

2. A method of mounting a loader on a tractor, the loader including mast structure having upright mast posts and an actuatable boom assembly rockably connected to the mast structure, said boom assembly including a material-engaging tool, the method comprising the steps of:

(a) attaching a mounting tube to the tractor;

(b) providing a downwardly opening pocket member at the lower end of the mast posts;

(c) moving the pocket member and mounting tube relative to each other until the pocket member engages the tube with the pocket member contacting the tube in a preselected position;

(d) after the step (c), rotating the mast structure about the mounting tube to a preselected mounted position;

(e) securing a portion of the mast structure at a location offset from the mounting tube to the tractor to maintain the past structure in the mounted position;

(f) providing complementary block and ramp structure adjacent the mounting tube and pocket; and (g) preventing disengagement of the pocket from the mounting tube, said step of preventing including, during the step (d), engaging the complementary block and ramp structure as the mast structure rotates on the tube to wedge the pocket against the tube;

(h) providing a downwardly and forwardly extending forward mast arm portion;

(i) pivotally connecting a stand member to the forward mast arm portion;

(j) providing latch structure on the pivoting stand structure; and (k) wherein the step of securing includes pivoting of the stand structure to latch the forward portion of the mast structure to the tractor.

3. The method as set forth in claim 2 including the steps of:

(l) providing a transversely extending beam structure on the pivoting stand;

(m) securing the pivoting stand structure in a preselected location when the mast structure is in the mounted position, wherein in the preselected location the beam structure acts as a guard for the forward end of the tractor.

4. The method as set forth in claim 2 wherein the step of providing complementary block and ramp structure includes supporting a block with a camming surface on the lower end of the upright mast post for rotation with the mast structure, supporting an inclined surface in the path of rotation of the camming surface of the block to urge the pocket downwardly as the mast structure is rotated upwardly about the mounting tube to the mounted position.

5. The method as set forth in claim 4 further including the step of adjusting the wedge relative to the ramming surface of the block to thereby adjust the fit between the pocket and the mounting tube.

6. The method as set forth in claim 1 wherein the step of wedging includes forcing the block between the mounting tube and inclined surface by actuating the boom assembly.

7. A method of mounting a loader on a tractor, the loader including mast structure having upright mast posts and an actuatable boom assembly rockably connected to the mast structure, said boom assembly including a material-engaging tool, the method comprising the steps of:

rockably connecting a ground support stand to the mast structure for rocking between a downwardly extended support position and an upwardly extended mounting position;

supporting the mast structure in a dismounted position on the downwardly extended support stand;

providing mast support structure on the vehicle and complementary support engaging structure on the mast structure;

providing upwardly opening hook-like structure on the mast structure;

driving the tractor adjacent the mast structure;

actuating the boom assembly to move the mast structure toward the mounted position on the vehicle, said step of actuating including moving the mast support structure and support engaging structure into contact, rotating the forward end of the mast structure upwardly about the mast support structure, and engaging the hook-like structure with a bracket located on the tractor as the forward end of the mast structure is rotated upwardly; and locking the mast structure to the tractor, said step of locking including rocking the ground support stand upwardly toward the mounting position and engaging the support stand and the bracket to maintain the hook-like structure in engagement with the bracket.

8. The invention as set forth in claim 7 including: providing complementary block and ramp structure on the mast support structure and support engaging structure, and automatically securing the mast support structure and support engaging structure by wedging the block and ramp structure together during the step of actuating of the boom assembly.

9. The invention as set forth in claim 7 further including, providing a protective member on the ground support stand and positioning the protective member adjacent the tractor for protecting the tractor when the support stand is in the mounted position.

10. The invention as set forth in claim 7 including: providing a transversely extending tubular member on the support stand to act as a structural member for the mast structure.

11. In a front end loader adapted for mounting on a framed vehicle such as a tractor, the loader including a mast having a rear upright mast post and a mast arm extending forwardly from the post, mounting structure comprising:

a support including a tubular beam;

means for connecting the support to the vehicle;

a downwardly opening pocket area located at the lower end of the mast post and adapted to engage the tubular beam;

means for rotating the mast arm upwardly about the beam from a lowered unmounted position to an upwardly rotated attached position;

means for preventing rearward movement of the pocket area relative to the beam as the mast arm is rotated upwardly;

means for wedging the pocket area firmly against the beam with increasing force as the mast approaches the upwardly rotated position, including a first camming surface connected to the tractor frame and a mating surface connected to the mast post for rotation with the mast arm against the camming surface; and means for releasably securing the mast arm in an upwardly rotated position.

12. The invention as set forth in claim 11 wherein the first camming surface is supported adjacent the beam, and including means supporting the mating surface on the mast post for engagement between the first camming surface and the beam.

13. The invention as set forth in claim 12 wherein the pocket area includes a channel-shaped member, and means for supporting the camming surface above the pocket area.

14. In a front end loader adapted for mounting on a framed vehicle such as a tractor, the loader including a mast having a rear upright mast post and a mast arm extending forwardly from the post, mounting structure comprising:

a support including a tubular beam;

means for connecting the support to the vehicle;

a downwardly opening pocket located at the lower end of the mast post and adapted for support on the tubular beam;

complementary block and wedge structure connected to the mast post and the support;

said support including means for guiding the pocket onto the beam in a preselected position with the structure offset from the wedge structure;

means for rotating the mast arm upwardly about the beam to engage the block and wedge structure and tightly secure the mast post against the beam;

means for releasably securing the mast arm in an upwardly rotated position; and means for adjusting the wedge structure relative to the block structure to compensate for wear in the support and in the pocket.

15. The invention as set forth in claim 11 including a parking stand having a transversely extending member, means for pivotally connecting the parking stand to the mast arm for rocking between a lowered ground support position and a raised mounted position, wherein when the stand is in the mounted position the member extends adjacent to and provides protection for the front end of the vehicle.

16. The invention as set forth in claim 15 including latch means operably associated with the parking stand for locking the mast arm in the upwardly rotated position, as the parking stand is rotated toward the mounted position.

17. In a front end loader adapted for mounting on a framed vehicle such as a tractor, the loader including a mast having a rear upright mast post and a mast arm extending forwardly from the post, mounting structure comprising;

a support including a tubular beam;

means for connecting the support to the vehicle;

a downwardly opening pocket located at the lower end of the mast post and adapted for support on the tubular beam;

complementary block and wedge structure connected to the mast post and the support;

said support including means for guiding the pocket onto the beam in a preselected position with the block structure offset from the wedge structure;

means for rotating the mast arm upwardly about the beam to engage the block and wedge structure and tightly secure the mast post against the beam;

means for releasably securing the mast arm in an upwardly rotated position including a parking stand having a transversely extending member, means for pivotally connecting the parking stand to the mast arm for rocking between a lowered ground support position and a raised mounted position, wherein when the stand is in the mounted position the member extends adjacent to and provides protection for the front end of the vehicle, wherein the means for releasably securing includes a front support connected to the vehicle frame and a hook-like member connected to the mast arm and adapted to engage the front support upon rotation of the mast arm upwardly about the beam, wherein the parking stand includes latch means for preventing disengagement of the hook-like member from the front support when the stand is in the mounted position.

18. In a front end loader adapted for mounting on a framed vehicle such as a tractor, the loader including a mast having a rear upright mast post and a mast arm extending forwardly from the post, mounting and stand structure comprising:

a parking stand;

means pivotally connecting the stand to the forward end of the mast arm for rocking with respect to the mast arm between a downwardly extending ground support position and an upwardly extending mounted position;

a rear support connected to the vehicle frame;

means for attaching the mast post to the rear support;

a front support connected to the vehicle frame;

means for rocking the mast between a parked position wherein the mast arm is supported on the ground from the parking stand when the stand is in the parking position, and an upward mounted position; and means connected to the parking stand for securing the mast arm to the front support as the parking stand is rotated with respect to the mast arm from the ground support position to the upwardly extending mounted position.

* * * * *

UNITED STATES PATENT AND TRADEMARK OFFICE

CERTIFICATE OF CORRECTION

PATENT NO. : 4,793,764

DATED : December 27, 1988

INVENTOR(S) : Nicholas Hamm

It is certified that error appears in the above-identified patent and that said Letters Patent is hereby corrected as shown below:

Col. 6, line 62, claim 2, change "past" to --mast--.

Col. 7, line 31, claim 5, change "ramming" to --camming--.

Col. 8, line 37, claim 11, after "mast" insert --arm--.

Col. 8, line 68, claim 14, before "structure" insert --block--.

Signed and Sealed this

Fourteenth Day of November, 1989

*Attest:*

JEFFREY M. SAMUELS

*Attesting Officer* *Acting Commissioner of Patents and Trademarks*